United States Patent [19]

Braad et al.

[11] 4,204,415

[45] May 27, 1980

[54] PROCESS AND APPARATUS FOR CONTINUOUSLY TRANSFORMING A STRIP TO AN ELONGATED PIPE

[75] Inventors: Poul E. Braad, Birkerød; Knud B. Jensen, Skodsborg; Hans Rosendal, Glostrup; Flemming Sevaldsen, Copenhagen, all of Denmark

[73] Assignee: Aktieselskabet Nordiske Kabel-og Traadfabriker, Copenhagen, Denmark

[21] Appl. No.: 905,070

[22] Filed: May 11, 1978

[30] Foreign Application Priority Data

May 13, 1977 [DK] Denmark ..... 2103/77

[51] Int. Cl.[2] ..... B21D 5/10; B21D 51/00

[52] U.S. Cl. ..... 72/52; 72/176

[58] Field of Search ..... 72/51, 52, 176, 368; 113/116 UT; 228/17.5, 146, 147, 148

[56] References Cited

U.S. PATENT DOCUMENTS

| | | | |
|---|---|---|---|
| 2,290,184 | 7/1942 | Higgins | 228/147 |
| 3,869,902 | 3/1975 | Iyengar et al. | 72/52 |
| 4,070,887 | 1/1978 | Hankin | 72/52 |

FOREIGN PATENT DOCUMENTS

| | | | |
|---|---|---|---|
| 1092424 | 11/1960 | Fed. Rep. of Germany | 72/52 |
| 706936 | 11/1930 | France | 72/52 |
| 40100 | 11/1971 | Japan | 72/176 |
| 22448 | 6/1972 | Japan | 72/176 |
| 1283951 | 8/1972 | United Kingdom | 72/52 |

*Primary Examiner*—Ervin M. Combs
*Attorney, Agent, or Firm*—Ladas & Parry

[57] ABSTRACT

A process and apparatus for continuously transforming a flat metal strip into an elongated pipe, in which the strip is fed through a forming tool along a curved forming path wherein the longitudinal edge portions are progressively turned up into cross-sectionally arcuate portions leaving between a substantially cross-sectionally rectilinear section, the width of which progressively decreases during travel of the strip through the forming tool. The curved forming path in the tool is such that it has a radius of curvature R(z) in its longitudinal direction, the arcuate portions each having a radius $r_o$ and the decreasing width of said rectilinear section being 2x(z) (wherein z is the distance of travel through the tool). The radius of curvature R(z) is controlled in sole dependence on $r_o$ and the differential quotient x'(z). In the resulting elongated tube, relative differences in travel distance between arbitrary areas in a transverse cross-section of the strip forming the pipe are substantially completely eliminated without plastic deformation in the longitudinal direction.

8 Claims, 10 Drawing Figures

PROCESS AND APPARATUS FOR CONTINUOUSLY TRANSFORMING A STRIP TO AN ELONGATED PIPE

The invention relates to a process and an apparatus for continuously transforming a flat metal strip into an elongated pipe. This art is of great importance in the production of metallic outer sheaths for example outer conductors for co-axial cables.

BRIEF DESCRIPTION OF THE PRIOR ART

It is known to produce cables with a cylindrical shield of a thin metal strip folded around the entire length of the cables, where the folding is effected by feeding the strip through a forming tool that may be constructed of rollers and/or templates of various types. The main problem in these forming processes is that the material in a strip cross section does not travel the same distance through the forming tool, which causes irregularities in the finished product if the elastic limit of the material is exceeded. Such irregularities have a disadvantageous effect on the electrical properties of the cable as will be explained later. To keep the stretching of the material within the elastic range it has been proposed to reduce the differences in the travelled distance through the forming tool by using folding zones of a very great length, see German Pat. No. 919 405. To avoid such very long machines it has been proposed to try to preliminarily deform the strip in such a manner that the subsequent deformation in the forming tool leaves the strip in such a state that all areas of the material in the transverse direction of the strip have been subjected to substantially the same plastic deformation, see German Offenlegungsschrift No. 2 519 462. This results in an undesirable reduction of the flexibility of the finished cable. German Auslegeschrift No. 1 800 981 teaches reducing the difference in distance by plastically preelongating the central area of the strip, however this also leads to disadvantages.

An important step towards reducing the differences in distance is disclosed in French Pat. No. 1 156 636 proposing to subject the strip to a curved course in the longitudinal direction during the forming or folding process. This principle has been examined by G. Ditges, see the magazine "Bänder Bleche Rohre" 1967, No. 4, p. 213–223, where it is said that it is possible to reduce the relative difference in distance to 1% by the tool length used, whereas the difference in distance is 1.9% when employing rectilinear feeding through the forming tool. Said curving in the longitudinal direction is also utilized in the art disclosed by the German Auslegeschrift No. 1 087 551, but the object of said publication is to obtain straight pipes by means of a uniform stretching of the strip over the entire width thereof.

The prior art thus provides no method of the type stated above where the relative difference in distance between areas of the material in the transverse direction of the strip may be reduced below about 1% unless the material in the finished pipe has been stretched relatively to the starting material or very long folding zones are used. These limitations are disadvantageous in the production of outer conductors for co-axial cables. The materials most used for such outer conductors will undergo a great plastic deformation at a relative length increase of 1% so that the length of the material of the finished product will be greater along the edges of the strip than at the centre of the strip, and this will therefore result in evenly spaced corrugations in the sheaths at the edges of the strip in the same manner as is shown in said article by Ditges, FIG. 21, p. 223. The distances between the corrugations will be of the same order as the wave length of the electromagnetic waves to be propagated through the co-axial cable, giving rise to resonance effect which entails that even small irregularities in the sheath may cause reflection of the electromagnetic waves. The corrugations in the cable resulting from the forming process may be obviated by the prior art where the sheath is uniformly plastically elongated, but, as mentioned, this leads to difficulties since the cable cannot be curved as much as a cable whose sheath is not plastically elongated because the curving must not result in evenly spaced corrugations in the sheath for the reasons mentioned above.

BRIEF SUMMARY OF THE INVENTION

The object of the invention is to provide a process and apparatus for continuously transforming a metal strip, preferably having a small thickness, into an elongated sheath so that any an arbitrary strip cross section is fed along a curved path having a radius of curvature R(z) through a forming tool and is caused to assume a substantially cross-sectionally rectilinear shape in the centre and a circular shape having a radius $r_o$ at the edges, the length 2x(z) of the substantially rectilinear section gradually decreasing through the tool in the feeding direction z of the strip, and where the curving in the longitudinal and transverse direction are controlled relatively to each other so that the difference in distance between arbitrary areas in the transverse direction of the strip is considerably smaller than those obtained until now, without plastic deformation of the material.

This object is achieved by controlling the radius of curvature R(z) of the path in sole dependence on $r_o$ and the differential quotient x'(z).

The invention is based on the recognition that only specific curve shapes among the many conceivable ones defining a curved forming path lead to the achievement of the above object, and that these specific curve shapes may collectively be defined by the connection between said parameters, as will be described in greater detail in the following description. A preferred embodiment of the process is characterized by substantially controlling R(z) in accordance with the expression $r_o/x'(z)^2$. In a particularly simple embodiment where x'(z) is kept constant also R(z) is constant.

The invention also relates to an apparatus for carrying out the subject process, said apparatus being of the type that comprises a forming tool consisting of one or more pairs of stationary opposed portions of an equal or unequal length, with guide faces for the strip, said guide faces defining a forming path having a radius of curvature R(z) and defining in pairs at least over part of their length an intermediate slot for receiving the strip, at least one of the guide faces transversely to the feeding direction comprising a substantially rectilinear central area being of a length 2x(z) decreasing in the feeding direction and being disposed between curved edge areas having a radius of curvature $r_o$. The guide faces are shaped so as to make R(z) solely determined by $r_o$ and the differential quotient x'(z).

Thus the apparatus comprises no rollers which when rotated might lead to periodic irregularities in the sheath, and the stationary forming portions obviate the periodical feeding effects on the material which are inevitable when movable forming trays are used. The characteristic shape of the slot gives a tool of a small length where the strip is transformed without plastic deformation in the longitudinal direction.

In a preferred embodiment of the apparatus of the invention the guide faces are shaped so that R(z) is substantially proportional to $r_o$ and inversely proportional to $x'(z)^2$. In another embodiment the guide faces are shaped so that x'(z) is constant. In both of these embodiments, the shape of the forming portions is particularly easy to bring about so that the tool becomes inexpensive. The apparatus is preferably used for applying an electrically conductive sheath around a cable, and for this object the forming portions are provided with a longitudinal recess for receiving an elongated workpiece, such as an insulated cable, fed together with the strip so that the strip forms a pipe around the workpiece.

Said radius $r_o$ is preferably selected to be the finished sheath radius, but may also be selected at any other smaller value provided that the subsequent counteracting of the elastic tension leaves the curved portion of the strip with the desired finished sheath radius.

Specifically when placing sheaths around cables the compensation for the counteracting of the plastic tension in the transverse direction cannot be effected for the last section of the central rectilinear portion of the strip cross section. The drawback stemming therefrom (the so-called spring-back effect) may be eliminated by supplementing the forming tool with a means which by adding perpendicular forces in a radial direction keeps the pipe sealed around the cable until it is subsequently secured permanently for example by welding, wrapping or extruded sheath. Such means may for example be a nozzle with narrow tolerances or a self-adjusting elastic element.

The invention will now be described in greater detail in the following detailed description with reference to the drawings wherein

BRIEF DESCRIPTION OF THE DRAWINGS

FIG. 1C shows the movement of an arbitrary point on the sheath;

DETAILED DESCRIPTION

Before the apparatus of the invention is described in greater detail we will explain how the parameters of the folding process should be related in order to lead to a substantially complete elimination of the differences in distance between regions in a strip cross section when said strip is transformed to a pipe without plastic deformation in the longitudinal direction. It will be shown that the transforming process according to the invention makes this substantially complete elimination possible in practice.

For this purpose the relative elongation $\epsilon$ of the strip (defined below) in the longitudinal direction will be defined with reference to FIG. 1A. The figure shows a point P in a strip cross section T spaced the distance z from the beginning of the forming zone, and the point P' to which P moves when the strip has travelled the distance dz without curvature in the feeding direction and has assumed the shape indicated at T'. When the rectilinear section OA of the strip travels the infinitesimal distance dz, the point P has been caused to travel the distance $\sqrt{dl^2+dz^2}$, and the relative elongation is then defined as $$\epsilon = \frac{\sqrt{dl^2 + dz^2} - dz}{dz} \tag{1}$$

Figure 1A:
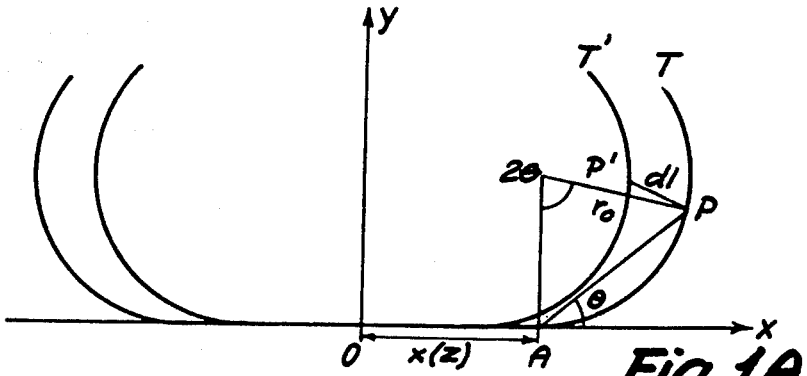
FIGS. 1A, 1B and 1C show the geometrical relations in an embodiment of the process of the invention.
Figure 1C:
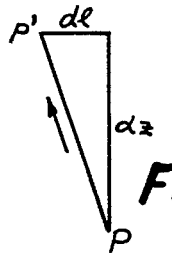

The distance dz is shown in FIG. 1c, *which indicates the movement of the point P to the point P' in a plane perpendicular to the x,y plane. The arrow shows the direction of movement.*

Figure 1B:
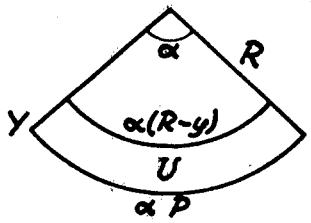
Figure 2:
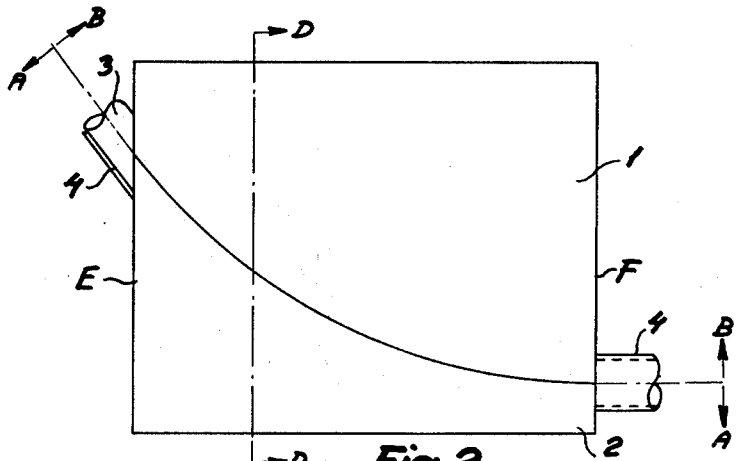
FIG. 2 is a side view of a set of forming portions of a forming tool comprising an upper portion and a lower portion for providing a co-axial cable with an outer conductor by the process of the invention.
Figure 3:
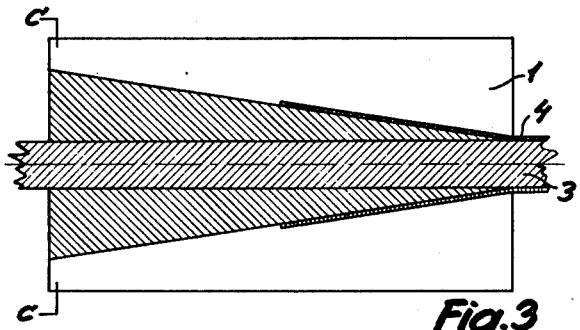
FIG. 3 is a sectional view of the upper forming tray taken along curved line B—B in FIG. 2.

In FIG. 1B the plane of the paper corresponds to the y,z plane of FIG. 1A so that the shown circular curvature is tantamount to the curving of the partially transformed U shaped section of the strip in the feeding direction with a radius of curvature R, measured down to the bottom of the strip, where the length of the U shaped section is $\alpha R$. At a height y above the bottom the length of the U shaped section is equal to $\alpha(R-y)$ which is smaller by 2 y than the length at the bottom of the strip. If this reduction be the equal of the increase in distance $\alpha R\epsilon$, that is $$\alpha y = \alpha R \epsilon \tag{2}$$

where $\epsilon$ is defined above without curvature in the feeding direction. The strip cross section at the height y will move the same distance as the bottom of the strip. This means that it is possible to eliminate completely a difference in distance in the longitudinal direction without imparting plastic deformations to the strip, provided that $$R = (y/\epsilon) \tag{3}$$

In practice R cannot be made dependent on y, and it is therefore necessary to require that $\epsilon$ is proportional to y. The following example provides a computation with reference to FIG. 1A to fulfill the requirements of Equation 3.

The point P has the coordinates $$P: \begin{cases} x = x(z) + r_o \sin 2\theta \\ y = 2r_o \sin^2\theta \end{cases} \tag{4}$$

The length s of the curve (see FIG. 1A) from the z axis to an arbitrary point P on the strip is $$s=x(z)+2r_o\theta \quad (5)$$

The term x(z) as used herein means the half width of the flat section of the strip from its center to the beginning of the arcuate portion, at any given point along the Z axis. The full width of the strip is therefore 2x(z).

During the forming operation the point P moves to point P', the respective curve lengths being sp and sp', where sp is the length measured from the z axis via the point A to the point P, and sp' is the length measured from the z axis via the point A' to the point P'.

As the strip must not be stretched, ds=sp÷sp' must be zero, resulting in $$ds=x'(z)dz+2r_o d\theta=0$$

this equation being derived from equation (5) by differentiation with respect to z and $\theta$. The term x'(z) as used herein means the differential quotient (dx(z)/dz), x(z) being defined above.

This gives $$(d\theta/dz)=-(x'(z)/2r_o) \quad (6)$$

Differentiation of (4) gives $$\left.\begin{aligned} dx &= x'(z)dz + 2r_o\cos 2\theta d\theta \\ dy &= 2r_o\sin 2\theta d\theta \end{aligned}\right\} \quad (6a)$$

It will be appreciated from FIG. 1A that the length of the infinitesimal line element dl is $$dl=\sqrt{dx^2+dy^2}$$

and substitution of equation (6a) gives $$dl=2\sin\theta\, x'(z)dz \quad (7)$$

where d$\theta$ is eliminated by means of equation (6).

First order approximation of equation (1) gives $$\epsilon\simeq\tfrac{1}{2}(dl/dz)^2 \quad (8)$$

Substituting Eq. 7 into Eq. 8, $$\epsilon\simeq 2x'(z)^2\sin^2\theta \quad (9)$$

Substituting y from Eq. 4 into Eq. 9, $$\epsilon\simeq\frac{x'(z)^2}{r_o}y \quad (10)$$

Equation (10) shows that it is possible to obtain the proportionality required in equation (3) between y and $\epsilon$ if R is made equal to $R=r_o/x'(z)2$ and thus the object of the invention is achieved and this has been shown by experiments on an industrial scale. Computations of the above type may further demonstrate that many forming processes employed until now, such as curving the strip from the bottom and upwards with a radius of curvature equal to the finished radius or making the cross section assume a circular shape with constantly decreasing radius, do not entail the above advantages.

FIGS. 2–7 show a divisible forming tool having two forming portions. An upper portion 1 and a lower portion 2 of the forming tool are shaped so as to provide a curved forming path with a radius of curvature R(z), where z denotes the feeding direction of the strip 4. The cable 3 is inserted from end E together with strip 4 which in the tool is formed into a sheath around the cable which leaves the forming tool at end F.

Figure 4:
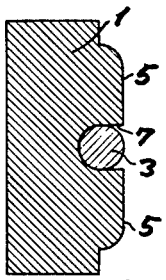
FIG. 4 is a sectional view of the upper forming with an inserted cable taken along the line C—C in FIG. 3.
Figure 7:
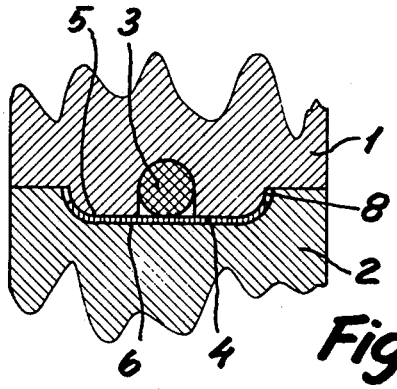
FIG. 7 is a partial sectional view of the forming portions with embedded strip and cable taken along line D—D in FIG. 2.

The upper portion 1 has, as will be seen from FIGS. 4 and 7, a guide face 5 provided with a central recess 7 for receiving the cable 3. The guide face 5 has a substantially rectilinear central area of width 2x(z) decreasing in the feeding direction zs between curved edge areas having a radius of curvature $r_o$.

Figure 5:
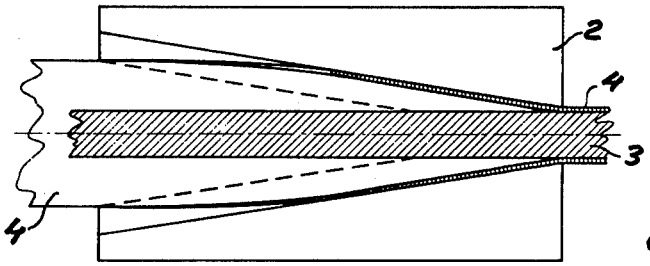
FIG. 5 shows the lower forming tray and a section of the cable being sheathed taken along curved line A—A in FIG. 2.
Figure 6:
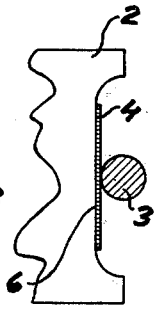
FIG. 6 shows part of the lower forming tray with a flat sheath and an inserted cable in place as seen from end E in FIG. 2

The lower portion 2 has, as will be seen from FIGS. 6 and 7, a guide face 6 which has a substantially rectilinear central area between curved edges. As the invention is intended for forming strips having a small thickness, the radius of curvature of the strip may be equal to $r_o$. In FIG. 5 the distance between the broken lines indicate the rectilinear section having width 2x(z), which decreases as we move from left to right in the feeding direction.

As will be seen in particular from FIG. 7 the forming portions 1 and 2 define as intermediate space 8 for deforming the strip 4. In the drawing the space extends over the entire length of the tool. However, when cables with sheaths are to be produced it is difficult to prepare the surface in the last portion because the material between the recess 7 and the curved portion of the guide face 5 becomes very thin. For this reason the upper forming portion 1 may advantageously be made shorter than the lower portion. The free part of the lower portion may then be shaped with an upwardly elongated guide face.

As mentioned above, the so-called spring-back effect can be neutralized by supplementing the forming tool with means adding perpendicular forces in a radial direction and thus secure the sheath around the cable.

Figure 8:
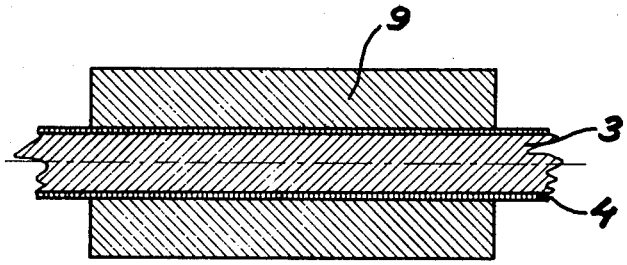
FIG. 8 is a sectional view of an embodiment in a means for counteracting of the elastic tension of the sheath.
Figure 9:
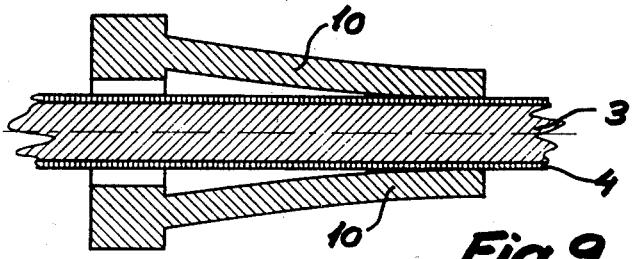
FIG. 9 is a sectional view of an alternative embodiment of the means for neutralizing the equalization in the elastic tension of the sheath.

Such means may for example, as illustrated in FIG. 8, be in the form of a sleeve 9 with narrow tolerances or as shown in FIG. 9 be in the form of a self-adjusting elastic element 10 optionally provided with one or more slots.

What we claim is:

1. In a process for continuously transforming a flat metal strip into an elongated pipe, by feeding the strip along a curved forming path between opposed portions of a forming tool and causing the strip to enter the forming tool at one end in a substantially flat condition throughout its width and progressively turning up longitudinal edge portions of the strip into cross-sectionally arcuate portions leaving between them a substantially cross-sectionally rectilinear section the width of which decreases during the travel of the strip through the forming tool, the improvement which comprises effecting said progressive turning up of said edge portions by using forming tool having at least one pair of opposed portions with guide faces defining the curved forming path, said guide faces having a radius of curvature R(z) in the longitudinal direction and having arcuate end portions in the transverse direction, said end portions having a radius of curvature $r_o$ and being interconnected by a rectilinear portion of a width 2x(z), where z is distance of travel through the tool, for controlling said radius of curvature R(z) in sole dependence on $r_o$ and the differential quotient x'(z), as the strip is fed along said curved forming path to substantially completely eliminate relative differences in travel distance between arbitrary areas in a transverse cross-section of the strip forming the pipe without plastic deformation of said strip in the longitudinal direction.

2. A process according to claim 1, wherein R(z) is controlled so as to be substantially proportional to $r_o$ and inversely proportional to $x'(z)^2$.

3. A process according to claim 1, wherein r(z) is controlled so as to be substantially proportional to $r_o$ and inversely proportional to $x'(z)^2$, x'(z) being kept constant.

4. In an apparatus for continuously transforming a flat metal strip into an elongated pipe having a forming tool having opposed portions defining a curved forming path for receiving the strip at one end in a substantially flat condition throughout its width and adapted to progressively turn up the longitudinal edge portions of the strip into cross-sectionally arcuate portions leaving between them a substantially cross-sectionally rectilinear section the width of which decreases during the travel of the strip through the forming tool, the improvement which comprises the provision of a forming tool having at least one pair of opposed portions with guide faces defining the curved forming path, said guide faces having a radius of curvature R(z) in the longitudinal direction and having arcuate end portions in the transverse direction, said end portions having a radius of curvature $r_o$ and being interconnected by a rectilinear portion of a width 2x(z), wherein z is the distance of travel through the tool, said radius of curvature R(z) being solely dependent on $r_o$ and the differential quotient x'(z), whereby relative differences in travel distance between arbitrary areas in the transverse cross-section of the strip forming the pipe are substantially completely eliminated without plastic deformation of said strip in the longitudinal direction.

5. Apparatus according to claim 4, wherein the guide faces are shaped so that R(z) is substantially proportional to $r_o$ and inversely proportional to $x'(z)^2$.

6. An apparatus according to claim 4, wherein the guide faces are shaped so that R(z) is substantially proportional to $r_o$ and inversely proportional to $x'(z)^2$ and so that x'(z) is constant.

7. Apparatus according to claim 4, wherein at least one of the opposed portions of the forming tool is provided with a longitudinal recess for receiving an elongated workpiece to be fed together with the strip, whereby the strip forms an elongated pipe around said workpiece.

8. Apparatus according to claim 7 including means for applying perpendicular forces to the strip in a radial direction to counteract the elastic tension of the strip after formation thereof in a pipe around the elongated workpiece.

* * * * *